US007748223B2

(12) United States Patent
Minoura

(10) Patent No.: US 7,748,223 B2
(45) Date of Patent: Jul. 6, 2010

(54) CONSTANT TEMPERATURE LIQUID BATH

(75) Inventor: Atsushi Minoura, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 853 days.

(21) Appl. No.: 10/941,994

(22) Filed: Sep. 16, 2004

(65) Prior Publication Data

US 2005/0086947 A1 Apr. 28, 2005

(30) Foreign Application Priority Data

Oct. 23, 2003 (JP) ..... 2003-363223

(51) Int. Cl.
*F25B 21/02* (2006.01)

(52) U.S. Cl. ..... 62/3.6; 62/3.1; 62/3.2; 62/3.62; 62/3.3; 62/3.7; 62/177; 62/371; 62/457.1; 62/457.6; 62/457.9; 62/407

(58) Field of Classification Search ..... 62/3.1, 62/3.2, 3.6, 3.62, 3.3, 3.7, 177, 371, 457.1, 62/457.6, 457.9, 407
See application file for complete search history.

(56) References Cited

U.S. PATENT DOCUMENTS

| | | | | |
|---|---|---|---|---|
| 3,348,556 | A * | 10/1967 | Layton | 134/57 R |
| 5,423,194 | A * | 6/1995 | Senecal | 62/457.6 |
| 5,718,124 | A * | 2/1998 | Senecal | 62/457.6 |
| 6,082,114 | A * | 7/2000 | Leonoff | 62/3.64 |
| 6,449,958 | B1 * | 9/2002 | Foye | 62/3.2 |
| 6,619,045 | B1 * | 9/2003 | Clark | 62/3.6 |
| 6,976,371 | B2 * | 12/2005 | Gleason et al. | 62/457.9 |
| 7,089,749 | B1 * | 8/2006 | Schafer | 62/3.2 |

FOREIGN PATENT DOCUMENTS

| | | |
|---|---|---|
| DE | 27 21 862 B2 | 11/1978 |
| EP | 1 184 649 A1 | 3/2002 |
| JP | 57-6976 | 1/1982 |
| JP | 10-281619 | 10/1998 |
| JP | 2002-321794 | 11/2002 |

* cited by examiner

*Primary Examiner*—Frantz F Jules
*Assistant Examiner*—Azim Rahim
(74) *Attorney, Agent, or Firm*—Oblon, Spivak, McClelland, Maier & Neustadt, L.L.P.

(57) ABSTRACT

A constant temperature liquid bath using a thermo-module in which even if an article whose temperature is to be controlled exists in the bath, the temperature of the liquid is efficiently adjusted to a constant value. The liquid bath includes an outer bath storing the liquid, an inner bath disposed in the outer bath through a gap, and including holes in its sidewall through which the liquid flows into the inner bath from the outer bath and an opening at a central portion of its bottom, and an agitator that causes the liquid to flow upward from the opening of the bottom of the inner bath between sidewalls of the inner and outer baths by a rotor blade disposed on a central portion of a bottom between the outer bath and the inner bath. The thermo-module is mounted on an outer surface of the sidewall of the outer bath.

7 Claims, 2 Drawing Sheets

CONSTANT TEMPERATURE LIQUID BATH

TECHNICAL FIELD

The present invention relates to a constant temperature liquid bath which heats and cools liquid in a bath using a thermo-module which adjust temperature by Peltier effect, and more particularly, to a constant temperature liquid bath suitable for immersing a container (bottle) accommodating chemical liquid and for adjusting its temperature at a constant temperature.

BACKGROUND ART

Conventionally, constant temperature liquid baths for constantly keeping a temperature of an object are widely used, and in recent years, a heat supply apparatus having a thermo-module which adjusts temperature by Peltier effect is also used in the constant temperature liquid baths (see Japanese Patent Application Laid-open Nos. 7-308592 and 2000-75935 for example). Since the heat supply apparatus using the thermo-module can heat and cool only by changing a supply direction of current, it is easy to control the temperature and the heat supply apparatus can be reduced in size, and such a heat supply apparatus is extremely suitable for a small constant temperature bath.

When any heat supply apparatus is used in the constant temperature liquid bath, heat is exchanged with respect to the heat supply apparatus below the constant temperature liquid bath while usually taking characteristics of liquid to be controlled in temperature into account, a stirring impeller is provided on a bottom of the constant temperature liquid bath, or a magnetic rotor is rotated by a stirrer motor to stir the liquid, thereby constantly keeping the temperature of the liquid.

However, the liquid is mainly stirred in the circumferential direction and is not positively stirred in the vertical direction. Therefore, when an object which needs to be constantly kept in temperature is accommodated in a container (bottle) and immersed, there are problems that the vertical flow of liquid is largely hindered by the object, the stirring effect in an upper portion of the bath is deviated from a predicted range, a temperature distribution in the bath becomes extremely poor, and a temperature difference is generated between upper and lower portions in the bath. More specifically, when the container is not immersed, the temperature distribution is in a range of 0.1° C., but if the container is immersed, the temperature distribution becomes about 0.5° C.

For this reason, also in the constant temperature liquid bath using the thermo-module, it is desired that uniform liquid flow is always generated on a heat transfer surface of the thermo-module even if an article is immersed in the constant temperature liquid bath and the liquid flows in the entire bath and the liquid in the bath is stirred in an overall manner.

DISCLOSURE OF THE INVENTION

The present invention has been accomplished to solve the problems in the conventional constant temperature liquid bath, and it is a technical object of the invention to provide a constant temperature liquid bath using a thermo-module which can efficiently exchange heat between a heat source and liquid, and constantly keeping the temperature of the liquid even if an article to be controlled in temperature is immersed in the bath, and which can easily and swiftly adjust the temperature.

To achieve the above object, the present invention provides a constant temperature liquid bath which includes a thermo-module for adjusting temperature by Peltier effect and which adjusts temperature of liquid in the bath by a heat supply apparatus, comprising an outer bath for storing the liquid, an inner bath disposed in the outer bath through a gap, and provided at its sidewall with a path through which the liquid flows into the inner bath from the outer bath and provided at a central portion of its bottom with an opening, and an agitator which introduces upward the liquid which flows from the opening of the bottom of the inner bath through sidewalls of the inner and outer baths by means of a rotor blade disposed on a central portion of a bottom between the outer bath and the inner bath, wherein the thermo-module of the heat supply apparatus is mounted on an outer surface of the sidewall of the outer bath, the temperature of the liquid flowing between the inner and outer baths is controlled to a set value based on output of a temperature sensor which detects the temperature of the liquid.

In a preferred embodiment of the constant temperature liquid bath of the present invention, the path of the sidewall of the inner bath is formed of a plurality of holes which are opened along the entire circumference of the sidewall of the inner bath. In this case, the holes may be formed in a plurality of stages in the vertical direction of the sidewall of the inner bath.

In another preferred embodiment of the constant temperature liquid bath of the invention, the path of the sidewall of the inner bath is formed on an overflow edge of a top of the inner bath which is formed lower than the sidewall of the outer bath.

Further, the path on the sidewall of the inner bath is deviated toward a portion or an upper portion of the sidewall opposed to the thermo-module. With this, a chance of liquid flowing through the thermo-module can be increased.

The outer bath and the inner bath may be cylindrical in shape and concentrically disposed, the outer bath may be polygonal prism in shape and the inner bath may be cylindrical in shape, and the inner bath may be disposed at a center of the outer bath, but the present invention is not limited to these structures.

In the constant temperature liquid bath having the above-described structure, if the rotor blade of the agitator is rotated in a state in which the liquid is charged into the outer bath, the liquid in the inner bath is sucked from the opening formed in the bottom of the inner bath, the liquid is stirred by the rotor blade by means of flow in the circumferential direction, and at the same time, upward flow is generated through the gap between the sidewalls of the outer bath and the inner bath, and its speed is relatively high. Therefore, while the liquid flows upward, heat is efficiently exchanged between the liquid and the thermo-module. Then, the liquid flows into the inner bath through the path formed in the upper portion of the sidewall of the inner bath and then flows downward in the inner bath. Thus, the liquid in the inner bath is always stirred in the vertical direction, and the temperature of the liquid is efficiently adjusted to a constant value. Further, as most portion of the liquid stirred by the rotor blade passes around the thermo-module at high speed, efficient heat exchange is carried out between the thermo-module and the liquid.

According to the constant temperature liquid bath of the present invention, heat can efficiently be exchanged between a heat source and liquid, and the temperature of the liquid can efficiently be adjusted constantly, and a temperature of desired liquid can easily and swiftly be adjusted constantly.

DETAILED DESCRIPTION OF THE INVENTION

Figure 1:
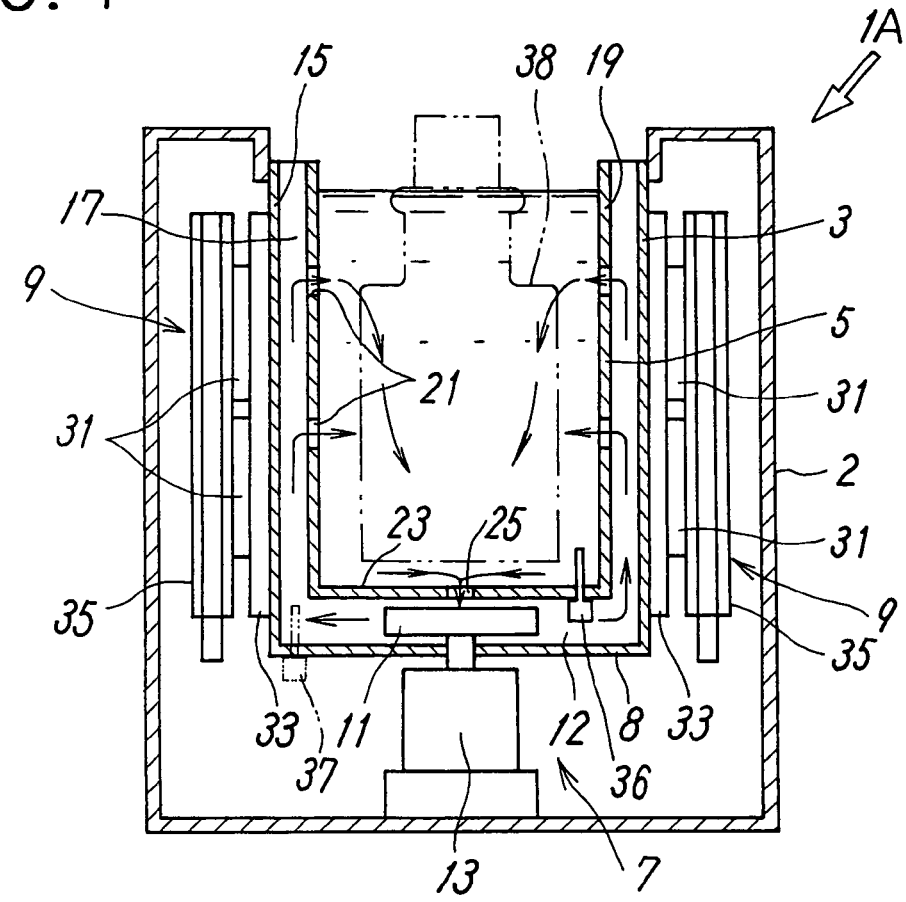
FIG. 1 is a sectional view showing an essential portion of a first embodiment of the present invention.

A constant temperature liquid bath of the present invention will be explained in detail based on embodiments illustrated in the drawings.

Figure 2:
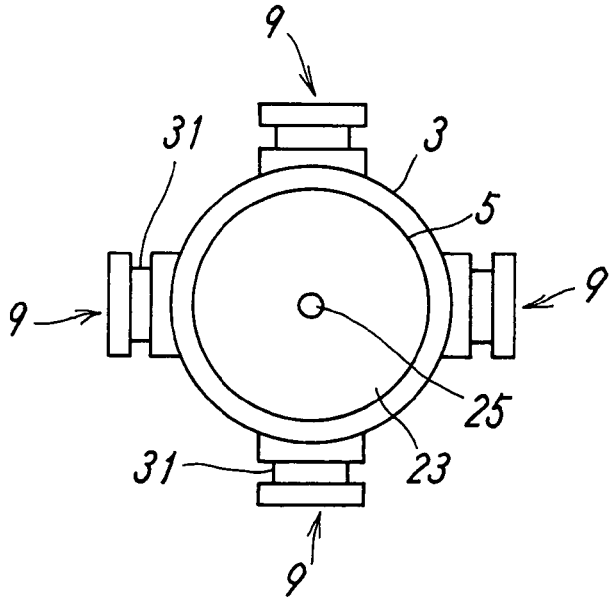
FIG. 2 is a plan view showing the essential portion of a first embodiment of the invention.

One of the embodiments is suitable for a case in which an object which hinders the flow of liquid is immersed in a bath, such as when chemical liquid of an MO-CVD (metal-organic chemical vapor deposition) apparatus is accommodated in a container (bottle) to adjust a temperature of the chemical liquid. As shown in FIGS. 1 and 2, a symbol 1A represents a constant temperature liquid bath. The constant temperature liquid bath 1A includes an outer bath 3 for storing liquid in a casing 2, an inner bath 5 disposed inside of the outer bath 3, an agitator 7 having rotor blade 11 disposed at a central portion of a bottom between the outer bath 3 and the inner bath 5, and a heat supply apparatus 9 which controls temperature of liquid flowing between the inner and outer baths 3 and 5 to a set temperature. The heat supply apparatus 9 has a thermo-module 31 mounted on an outer surface of the outer bath 3.

As can be seen in FIG. 2, the outer bath 3 and the inner bath 5 are concentric bottomed cylindrical bodies. A rotor blade chamber 12 for accommodating the rotor blade 11 of the agitator 7 is formed between bottoms 8 and 23 of the outer bath 3 and the inner bath 5. The outer rotor blade 11 is connected to a motor 13 through a through hole of the bottom of the outer bath 3. An opening 25 through which liquid in the inner bath 5 flows to the rotor blade chamber 12 is formed in a central portion of the bottom 23 of the inner bath 5. With this structure, liquid flows to the rotor blade chamber 12 between the bottoms 8 and 23 of the inner and outer baths 3 and 5 having the rotor blade 11 from the opening 25, and the liquid is stirred in the circumferential direction by the action of the rotor blade 11, and at the same time, liquid is introduced upward through a gap 17 between a sidewall 15 of the outer bath 3 and a sidewall 19 of the inner bath 5. The rotor blade 11 includes a centrifugal blade which allows liquid to flow in a centrifugal direction. Rotation of the centrifugal blade makes the liquid flow toward the gap 17 as shown with arrows in FIG. 1.

The sidewall 19 of the inner bath 5 is opposed to an inner surface of the sidewall 15 of the outer bath 3 through a substantially constant gap 17. A plurality of holes 21 are formed in the entire circumference of the sidewall 19 in a plurality of (two in the drawing) stages. The holes 21 form paths through which liquid which flows upward in the gap 17 flows from the outer bath 3 to the inner bath 5 through the holes 21. The holes 21 of the sidewall 19 of the inner bath 5 can be provided evenly in the circumference of the sidewall 19. Alternatively, the holes 21 may be formed intensively in a portion of the sidewall 19 opposed to the thermo-module 31 or an upper portion thereof. With this design, a chance of flow of liquid around the thermo-module 31 is increased, and the temperature adjusting effect can be enhanced.

The bottom 23 of the inner bath 5 is formed with an opening 25 through which liquid flows to the outer bath 3 through the rotor blade chamber 12, as previously mentioned.

The heat supply apparatus 9 comprises the thermo-module 31 which adjusts temperature by Peltier effect, a heat-absorbing plate 33 which supplies heat through the sidewall 15 of the outer bath 3, and a radiating section 35 provided on opposite side from the heat-absorbing plate 33. The thermo-module 31, the heat-absorbing plate 33 and the radiating section 35 are layered on one another. A temperature sensor 36 which detects a temperature of liquid in the bath is provided in the inner bath 5. The thermo-module 31 and the temperature sensor 36 are connected to a control device which controls the liquid temperature in the bath to a predetermined set temperature based on output of the temperature sensor 36. Instead of the temperature sensor 36 provided in the inner bath 5, a temperature sensor 37 may be provided in the outer bath 3 as shown in FIG. 1.

In the first embodiment, four thermo-modules 31 in the heat supply apparatus 9 are mounted on the outer surface of the sidewall 15 of the outer bath 3 in 90° intervals. Although the thermo-modules 31 are mounted over the substantially entire vertical region of the sidewall, the mounting design can appropriately be set in accordance with temperature adjusting conditions.

When the constant temperature liquid bath 1A having the above-described structure is used in an MO-CVD apparatus, fluorine-based liquid is usually used as the chemical liquid which adjusts the temperature of the liquid at a constant value, and this liquid is charged into the outer bath 3.

If the heat supply apparatus 9 is operated and the rotor blade 11 is rotated by the motor 13 while controlling the temperature by the thermo-modules 31, the liquid in the inner bath is sucked into the rotor blade chamber 12 from the opening 25 formed in the bottom 23 of the inner bath 5. The liquid coming out from the rotor blade chamber 12 is stirred in the circumferential direction, and at the same time, an upward flow is generated through the gap 17. Since this liquid flow is relatively fast, heat is exchanged efficiently between the thermo-modules 31 while the liquid flows upward. Then, the liquid passes through the plurality of holes 21 formed in the sidewall 19 of the inner bath 5 and flows into the inner bath 5 and downward therein. The liquid again flows into the rotor blade chamber 12 through the opening 25 formed in the bottom plate of the inner bath 5, and a liquid flow circulating through the outer bath 3 and the inner bath 5 is formed as shown with the arrows in FIG. 1. The heat exchange is carried out constantly by the circulating liquid flow, and the liquid temperature in the bath including the outer bath 3 and the inner bath 5 is adjusted to a constant value.

Therefore, even if the chemical liquid bottle 38 whose temperature is to be controlled is immersed in the inner bath 5, the liquid in the inner bath 5 is always excellently stirred in the vertical direction, and the temperature of liquid is efficiently adjusted to the constant value. Further, most of liquid stirred by the rotor blade 11 flows in the vicinity of the thermo-module 31 at high speed when the liquid flows upward through the gap 17, and thus, efficient heat exchange is carried out between the thermo-module 31 and the liquid.

Figure 3:
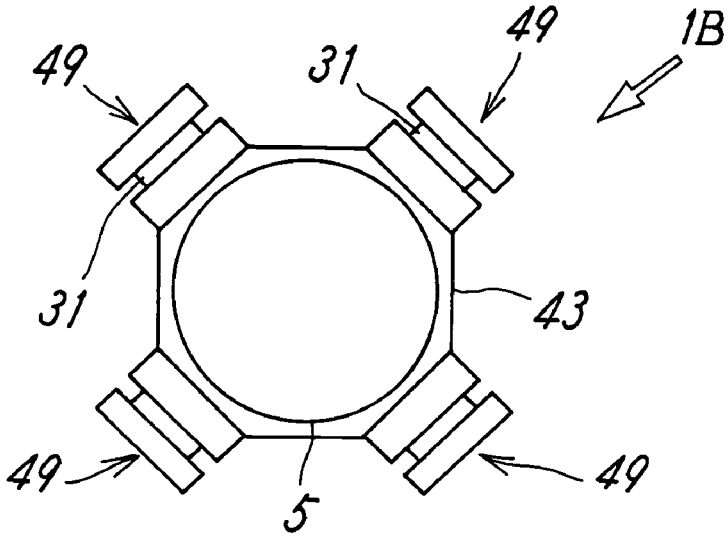
FIG. 3 is a plan view showing the essential portion of a second embodiment of the invention.

FIG. 3 shows a second embodiment of the present invention. A constant temperature liquid bath 1B of the second embodiment is different from the constant temperature liquid bath 1A of the first embodiment in the structure of the outer bath. That is, an outer bath 43 of the second embodiment is of regular octagonal prism, and heat supply apparatus 49 are respectively provided alternately on four of eight surfaces of the outer wall. Other structure, the operation and the effect are the same as those of the first embodiment and thus, explanation thereof is omitted.

Figure 4:
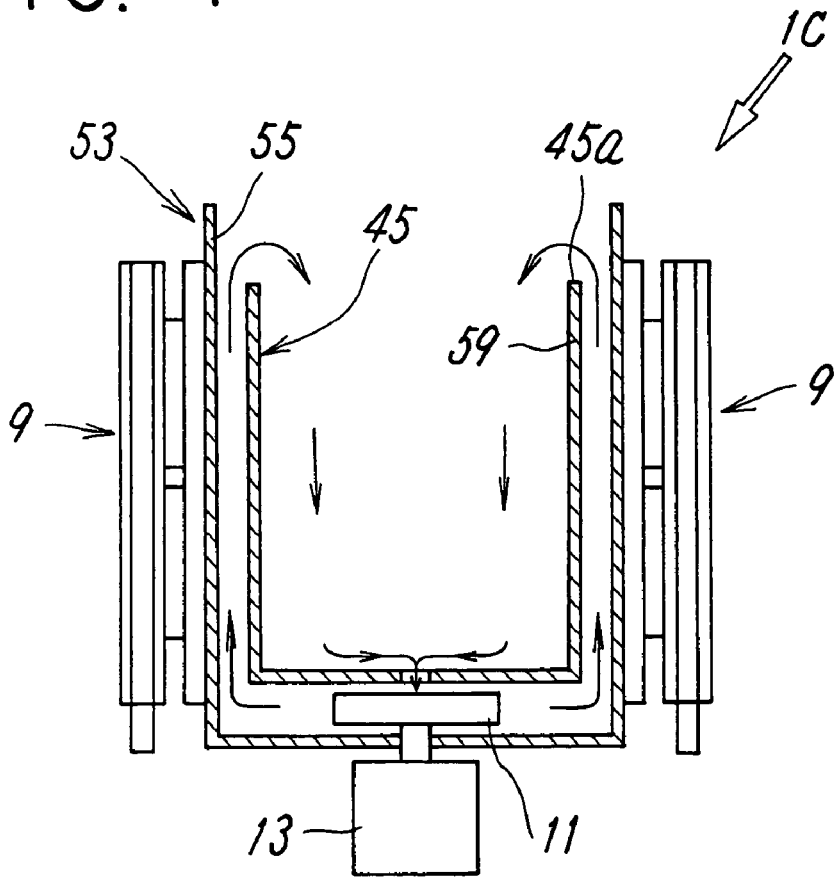
FIG. 4 is a sectional view showing the essential portion of a third embodiment of the invention.

FIG. 4 shows a third embodiment of the present invention. A constant temperature liquid bath 1C of the third embodiment is different from the constant temperature liquid bath 1A of the first embodiment in the structure of the inner bath. That is, in the third embodiment, an inner bath 45 is a bottomed cylindrical body. A sidewall 59 of the inner bath 45 is lower than a side wall 55 of an outer bath 53. A peripheral edge of a top of the inner bath 45 is formed as an overflow edge 45*a*, and a path through which liquid flows from the outer bath 53 into the inner bath 45 is formed above the overflow edge 45*a*.

The height of the overflow edge 45*a* may partially be varied, an upper portion of the overflow edge 45*a* opposed to the thermo-module 31 may be reduced in height so that a chance of liquid flowing in the vicinity of the thermo-module 31 is increased, and the temperature adjusting effect can be enhanced.

Other structure, the operation and the effect are the same as those of the first embodiment and thus, explanation thereof is omitted.

The outer bath of the constant temperature liquid layer of the present invention is not limited to the cylindrical body or the regular octagonal prism, and prism such as a regular square prism or regular hexagonal prism can also be used.

The invention claimed is:

1. A constant temperature liquid bath that adjusts a temperature of liquid in the bath by a heat supply apparatus having a thermo-module for adjusting temperature by Peltier effect, the constant temperature liquid bath comprising:

an outer bath that stores the liquid;

an inner bath disposed concentrically with the outer bath at an inside of the outer bath, through a gap, and including a bottom that is parallel to a bottom of the outer bath, and including only one hole at the bottom of the inner bath, the hole passing through the center of the bottom of the inner bath;

a rotor blade chamber formed between the bottom of the outer bath and the bottom of the inner bath, communicating with an inside of the inner bath through the hole, and including a rotor blade at a central portion of the inside of the rotor blade chamber, a centrifugal blade of the rotor blade circulating the liquid that flows from the hole in a centrifugal direction along the bottom of the outer bath and the bottom of the inner bath, the centrifugal blade of the rotor blade mounted so as to be positioned at only the inside of the rotor blade chamber, and the hole is positioned at a center of the rotor blade within a rotating region of the centrifugal blade;

an agitator introducing the liquid into the gap by driving the rotor blade, and to cause liquid that flows into the rotor blade chamber from the hole of the bottom of the inner bath to flow upward in the gap;

wherein the thermo-module is mounted on an outer surface of the sidewall of the outer bath, and is configured to adjust a temperature of the liquid by exchanging heat with the liquid flowing upward in the gap through the sidewall of the outer bath, wherein the liquid flowing upward in the gap, which has had its temperature adjusted by the thermo-module, flows into the inner bath, and further comprising a temperature sensor configured to detect a temperature of liquid in the inner bath or outer bath to control adjusting a temperature of the liquid in the constant temperature liquid bath to a set temperature.

2. The constant temperature liquid bath according to claim 1, further comprising a plurality of holes opening along the circumference of the sidewall of the inner bath, through which the liquid flows into the inner bath.

3. The constant temperature liquid bath according to claim 2, wherein the plurality of holes are formed in a plurality of stages in the vertical direction of the sidewall of the inner bath.

4. The constant temperature liquid bath according to claim 1, wherein an overflow edge of a top of the inner bath is formed lower than the sidewall of the outer bath, over which the liquid flows into the inner bath.

5. The constant temperature liquid bath according to any one of claims 1 to 4, wherein the path for liquid flowing is deviated toward a portion or an upper portion opposed to the thermo-module.

6. The constant temperature liquid bath according to any one of claims 1 to 4, wherein the outer bath and the inner bath are cylindrical in shape and concentrically disposed.

7. The constant temperature liquid bath according to any one of claims 1 to 4, wherein the outer bath is polygonal prism in shape and the inner bath is cylindrical in shape, and the inner bath is disposed at a center of the outer bath.

* * * * *